United States Patent [19]

Corbi

[11] Patent Number: 4,524,741

[45] Date of Patent: Jun. 25, 1985

[54] PRESET THROTTLE RELEASE DEVICE

[76] Inventor: Ronald W. Corbi, 368 Edgewood Dr., Columbiana, Ohio 44408

[21] Appl. No.: 609,028

[22] Filed: May 10, 1984

[51] Int. Cl.[3] ..... F02D 3/00

[52] U.S. Cl. ..... 123/342; 123/337; 123/396; 123/398; 123/400; 180/170

[58] Field of Search ..... 123/398, 342, 396, 399, 123/400, 337, 352; 180/170

[56] References Cited

U.S. PATENT DOCUMENTS

| | | | |
|---|---|---|---|
| 2,866,446 | 12/1958 | Feuerstein | 123/400 |
| 2,916,116 | 12/1959 | Eddy et al. | 123/337 |
| 3,439,783 | 4/1967 | Graham et al. | 123/398 |
| 3,675,731 | 7/1972 | Stopera | 123/337 |
| 3,791,366 | 2/1974 | MacMillan | 123/337 |
| 3,888,219 | 6/1975 | Rogerson | 123/396 |
| 4,359,028 | 11/1982 | Fiala | 123/399 |
| 4,362,138 | 12/1982 | Krueger et al. | 123/352 |

*Primary Examiner*—E. Rollins Cross
*Attorney, Agent, or Firm*—Harpman & Harpman

[57] ABSTRACT

A preset throttle release device for use on drag racing cars to manually set a throttle linkage position at a desired setting restricting the maximum engine rpm at the beginning of a race. The device once set can be released providing a full range of throttle position once the race has begun.

6 Claims, 3 Drawing Figures

PRESET THROTTLE RELEASE DEVICE

BACKGROUND OF THE INVENTION

1. Technical Field

This invention relates to drag racing cars in controlled races wherein the object is to obtain the lowest elapsed time for traveling between two set points from a standing start. In order to obtain the best time, it is important that the race car leave the starting line as quickly as possible in a consistent manner from one race to the next. This invention presets the limit of throttle travel to a desired engine rpm to maximize performance in relation to car and track conditions. This invention presets the throttle while allowing free control of the throttle travel up to a preset position and full control the throttle after it has been released.

2. Description of the Prior Art

Prior art devices of this type have heretofore attempted to regulate the throttle linkage within boundaries set by the relative speed of the engine. See for example U.S. Pat. Nos. 3,675,731 and 4,362,138.

In U.S. Pat. No. 3,675,731, a vehicle speed control throttle governor is disclosed wherein an adjustable throttle limit is imposed in relation to the relative speed of the vehicle.

U.S. Pat. No. 4,362,138 shows a changeable length accelerator-carburetor speed regulator linkage having an adjustable spring bias armature that limits the throttle travel by restricting movement of the spring bias armature.

Applicant's device presets the throttle linkage of a carburetor position by temporarily restricting the travel of the linkage by adjustably shortening a control cable connected thereto.

SUMMARY OF THE INVENTION

A preset throttle release device that adjustably restricts the amount of throttle travel so that a predetermined rpm can be held and quickly released on command allowing full use of the throttle range. The device once set can consistently return to the preset position or be adjusted to a new throttle position by effectively shortening a control cable and release mechanism engaging the throttle linkage.

DESCRIPTION OF THE PREFERRED EMBODIMENT

Figure 1:
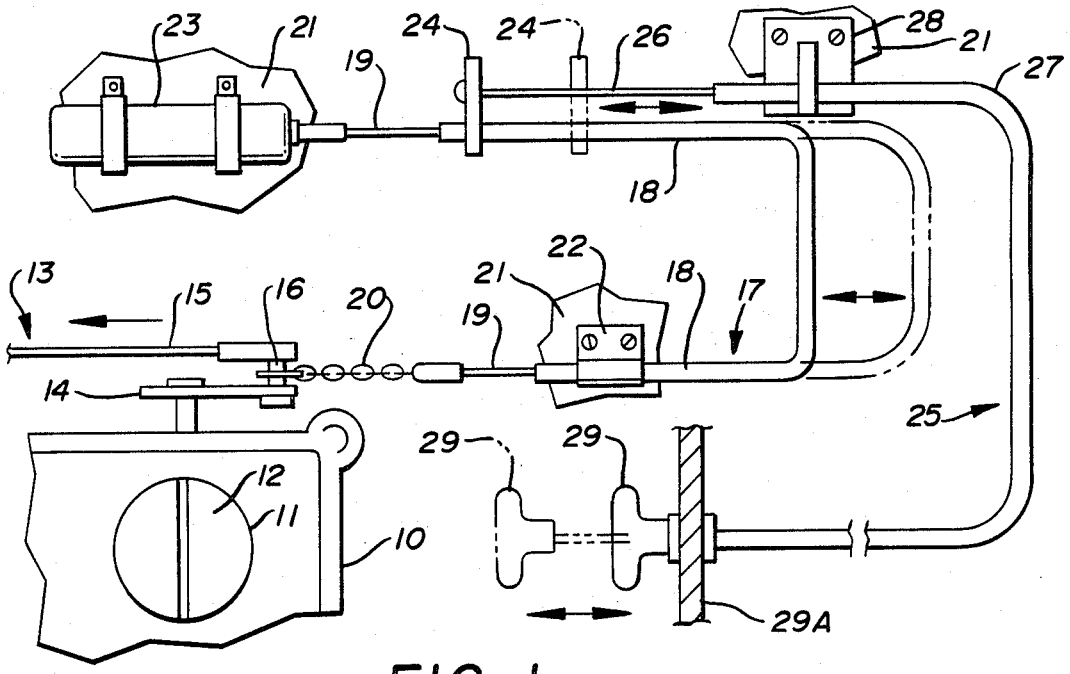
FIG. 1 is a schematic view illustrating the preset throttle release device on a portion of a throttle linkage.

Referring now to FIG. 1 of the drawings, a portion of a carburetor 10 can be seen having a throat 11, a throttle plate 12 and a throttle linkage 13. The throttle linkage 13 has a control arm 14 that is connected in this example to a throttle linkage cable 15 by a control pin 16. It will be evident from the above description that as the control arm 14 moves in response to the throttle linkage cable 15, the throttle plate 12 is moved proportionally adjusting the speed (rpm) of the engine, not shown.

A preset throttle release device is shown connected to the throttle linkage 13 and comprises a first cable assembly 17 having a first cable sheath 18 and a first cable member 19 within as is well known in the art. One end of the first cable member 19 is pivotally secured to the control pin 16 via a beaded chain 20 and is secured adjacent the carburetor 10 to a wall 21 by a cable fastener 22 engaging only the first cable sheath 18.

The other end of the first cable member 19 is in communication with a cable release device 23 secured to a portion of the wall 21. The cable release device 23 will be described more fully at a later point in the description.

Still referring to FIG. 1 of the drawings, it will be seen that the other end of the first cable sheath 18 is secured to a movable sheath clip 24. A secondary cable assembly 25 has a secondary cable member 26 within and a secondary cable sheath 27 and is secured at one end adjacent the cable release 23 to a portion of the wall 21 by a secondary cable sheath fastener 28 as will be well understood by those skilled in the art. The secondary cable member 26 is secured at one end to the movable sheath clip 24 and at the other end to a control knob 29 mounted on the dashboard 29A of a race vehicle, not shown.

It can readily be seen that by pulling on the control knob 29 that the secondary cable member 26 that is secured at its opposite end to the sheath clip 24 will move the same along with the first cable sheath 18 attached thereto to a new position as illustrated in the broken lines in FIG. 1 of the drawings.

Figure 2:
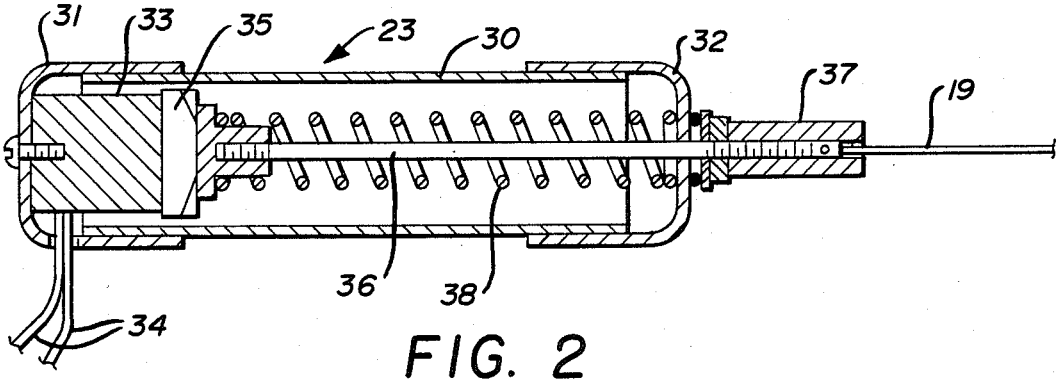
FIG. 2 is an enlarged cross sectional view of a cable release portion of the device.

Referring now to FIG. 2 of the drawings, the cable release 23 can be seen having a cylinder 30 with a pair of apertured end caps 31 and 32 on opposite ends thereof. An electromagnet 33 having power supply wires 34 extending therefrom is secured within the end cap 31. A ferrous metal guide member 35 abuts the free end of said electromagnet 33. A control rod 36 extends from said ferrous metal guide member 35 outwardly of said cylinder and into a guide sleeve 37 axially aligned with said aperture in the end cap 32. A spring 38 is positioned over said rod 35 within said cylinder 30 engaging said end cap 32 and said ferrous metal guide member 35. The first cable member 19 is attached to the free end of said control rod 36 and as previously indicated is secured to the throttle linkage 13.

Figure 3:
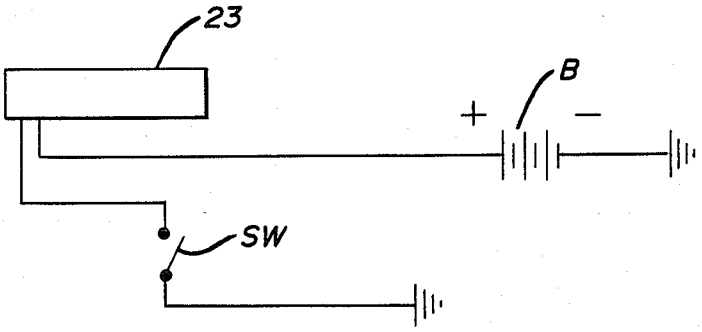
FIG. 3 is a diagram of the electric control circuit used to actuate the device.

In operation, the cable release 23 is connected to a power source, the vehicle's battery B, via its supply wires 34 and a switch SW as can be seen in FIG. 3 of the drawings.

Referring now to FIGS. 1 and 2 of the drawings, in operation the driver activates the preset throttle release device by first activating the electromagnet 33 by energizing the same by turning the switch SW on which holds the ferrous metal guide member 35 and attached control rod 36 against the energized electromagnet 33. The driver then advances the throttle linkage 13 to increase the engine rpm to the desired level. By so doing, the first cable member 19 is moved along with the first sheath 18 as seen in broken lines to a new position. The control knob 29 is advanced and locked moving the first sheath 18; the effect of which is to shorten the first cable member 19 and lock the same in that position. The driver now has a preset throttle linkage position determined by restricting engagement of the first cable assembly 17 on the throttle linkage 13 allowing for throttle linkage travel only to that point which is predetermined prior to the race. Once the preset throttle position has been reached, the driver may then deactivate the electromagnet 34 within the cable release 23 via the switch SW freeing the ferrous metal guide member 35 and attached control rod 36 allowing for free travel of the first cable member 19 and the attached throttle linkage 13. Free unrestricted movement of the throttle linkage 13 is now possible since the first cable member 19 has been effectively lengthened.

The preset throttle release device provides a relatively simple and foolproof way of selectively restricting temporarily the throttle linkage travel to a predetermined and advantageous position for consistently fast starts required in the sport of drag racing.

It will thus be seen that a new and useful device has been illustrated and described and it will be apparent to those skilled in the art that various changes and modifications may be made therein without departing from the spirit of the invention and having thus described my invention what I claim is:

1. A preset throttle release for use on drag racing vehicles including an engine, a throttle linkage movable between a full opened and a closed position wherein said preset throttle release comprises a first cable assembly extending between said throttle linkage and a selective cable restraint means, said first cable assembly having a predetermined effective length for normal throttle linkage travel, means for adjustably foreshortening the effective length of said first cable assembly wherein said throttle linkage travel is restrained, means for presetting said effective length of said first cable assembly and means for releasing said foreshortened effective length of said first cable assembly while maintaining said presetting of said effective length of said first cable assembly.

2. The preset throttle release of claim 1 wherein said selective cable restraint means comprises a cable release having a spring biased cable and an electromagnetic cable engagement.

3. The preset throttle release of claim 1 wherein said means for adjustably foreshortening the effective length of said first cable assembly comprises a second cable assembly connected between said first cable assembly and said means for preselecting said effective length.

4. The preset throttle release of claim 1 wherein said means for presetting said effective length of said first cable assembly comprises a control knob movably positioning a portion of said first cable assembly.

5. The preset throttle release of claim 1 wherein said means for releasing said foreshortened effective length of said first cable assembly comprises an electrically controlled circuit.

6. The preset throttle release of claim 5 wherein said electrically controlled circuit comprises a switch in communication with a power source and said selective cable restraint means.

* * * * *